US005811945A

United States Patent [19]

Hellinger et al.

[11] Patent Number: 5,811,945

[45] Date of Patent: Sep. 22, 1998

[54] TRAVELING GEAR WITH OSCILLATION DAMPING

[75] Inventors: Frank Hellinger, Künzelsau, Germany; Ari Vaisānen, Hyvinkää, Finland

[73] Assignees: R. Stahl Fordertechnik GmbH, Kunzelsau, Germany; KCI Konecranes International PLC, Hyvinkaa, Finland

[21] Appl. No.: 619,879

[22] Filed: Mar. 20, 1996

[30] Foreign Application Priority Data

Mar. 21, 1995 [DE] Germany ..... 195 10 167.7

[51] Int. Cl.[6] ..... B66C 13/06

[52] U.S. Cl. ..... 318/246; 318/286; 318/369; 212/272

[58] Field of Search ..... 21/272–275; 318/245, 318/246, 247–252, 280–300, 364–381

[56] References Cited

U.S. PATENT DOCUMENTS

| | | | |
|---|---|---|---|
| 3,965,404 | 6/1976 | Petersen | 318/261 |
| 4,997,095 | 3/1991 | Jones et al. | 212/147 |
| 5,319,292 | 6/1994 | Backstrand | 318/371 |
| 5,490,601 | 2/1996 | Heissat eyt al. | 212/275 |
| 5,495,955 | 3/1996 | Shibata | 212/275 |
| 5,550,733 | 8/1996 | Yun et al. | 364/174 |

FOREIGN PATENT DOCUMENTS

| | | |
|---|---|---|
| 0 089 662 | 9/1983 | European Pat. Off. . |
| 0 691 301 | 1/1996 | European Pat. Off. . |
| 2399378 | 3/1979 | France . |
| 2615459 | 11/1988 | France . |
| 591809 | 1/1934 | Germany . |
| 14 31 907 | 10/1969 | Germany . |
| 19 23 887 | 11/1969 | Germany . |
| 20 22 745 B2 | 5/1970 | Germany . |
| 27 55 201 A1 | 12/1977 | Germany . |
| 32 10 450 C2 | 3/1982 | Germany . |
| 37 22 738 | 1/1988 | Germany . |
| 40 25 749 | 2/1992 | Germany . |
| 2114319 | 8/1983 | United Kingdom . |
| 2161436 | 1/1986 | United Kingdom . |
| WO 92/18416 | 10/1992 | WIPO . |

*Primary Examiner*—Brian Sircus
*Attorney, Agent, or Firm*—Nilles & Nilles, S.C.

[57] ABSTRACT

A travel drive for a trolley traveling gear of hoists has a drive train which has the properties of a freewheel as regards the direction of travel. Consequently load oscillation can be rapidly damped out because the speed of the traveling gear is not forcibly held constant during the semioscillation of the load in which it moves ahead of the traveling gear. On the contrary, the swinging load is able to drag the traveling gear behind it, accelerating it in the process, and in this way to convert oscillation energy into driving energy.

36 Claims, 4 Drawing Sheets

TRAVELING GEAR WITH OSCILLATION DAMPING

BACKGROUND OF THE INVENTION

It is known practice in the prior art to equip traveling gears of hoists with asynchronous motors where the intention is to allow the hoists to run under power along a running rail. Asynchronous motors run at essentially constant speeds and also generally have a relatively high starting torque, which leads to jerky acceleration when starting the traveling gear. This sharp acceleration does not present a problem while the chain of the hoist is not significantly extended, i.e. the load has not been lowered to any significant extent. The problem arises when there is a need to start with the load lowered on a long chain.

The traveling gear equipped with an asynchronous motor accelerates rapidly and, after a short distance, assumes a constant speed of travel. The result of the jerky acceleration of the traveling gear is that the load hanging from the greatly extended chain starts to oscillate, and the oscillation does not stop even when the traveling gear is moving at a constant speed. The motion of the load can be analyzed into two components, namely 1) a uniform motion in the direction of travel, and 2) an oscillating motion with a tendency alternately to decelerate or accelerate the traveling gear. Because of the harsh characteristic of the asynchronous motor, the traveling gear cannot comply with this force induced by the oscillating motion and, as a result, the traveling gear acts as a rigid, fixed mounting for the oscillating-motion component.

A number of proposals have therefore already been made in practice for regulating the speed of the asynchronous motor so that the oscillation is either avoided, where possible, or damped as far as possible. The outlay in terms of measurement technology necessary for this purpose is very high, and the control equipment is also very expensive.

OBJECTS AND SUMMARY OF THE INVENTION

Taking this as a starting point, it is the object of the invention to provide a traveling gear for hoists which, with a lower outlay, gives rise to less severe oscillation of the load hanging from the carrying element or rapidly damps the oscillation of the load.

According to the invention, this object is achieved by means of a traveling gear with an electric drive system which is kinematically connected to at least one wheel of the traveling gear. The drive system includes a device which is coupled to the power source and which gives the drive system at least approximately the characteristics of a one-way clutch. Accordingly, in the case of an externally acting force that tends to accelerate the traveling gear, there is essentially no power transmission from the drive system to the wheel.

In the case of a drive system with freewheel characteristics, the traveling gear can follow the oscillating motion because the traveling gear can follow the load during the forward swing of the load. These characteristics of the drive system make it possible to convert the oscillation energy into driving energy and, as a result, the oscillation of the load ceases after a relatively short distance and the load moves at the same speed as the traveling gear.

Admittedly, the processes which lead to rapid damping of the oscillation of the load in the new solution are not yet fully understood. The following interactions are suspected:

When the traveling gear is accelerated by the motor with the hook load in a state of rest, the traveling gear moves a significant distance from the position of rest before the load hanging from the hook likewise accelerates in the direction of travel. If this gives rise to a jerky acceleration from a standstill, the jerky acceleration induces oscillation of the load. Owing to the oscillation of the load, the load will have a tendency after a certain distance traveled by the traveling gear to move ahead of the traveling gear i.e. the oscillating load is pulling the traveling gear and has a tendency to accelerate it. In contrast to simple asynchronous motors, the traveling gear equipped with the novel drive system can follow this acceleration caused by the oscillation of the load. The energy of the oscillating load is in this way converted to driving energy which keeps the traveling gear in motion. Only when the speed of travel of the traveling gear falls below the desired value again will the drive system take over the propulsion of the traveling gear again, although a considerable portion of the oscillation energy has already been converted into driving energy. In this way, the oscillation of the load has to a large extent already been damped virtually the first time the traveling gear is overtaken by the load.

Such drive characteristics can be achieved either by means of an asynchronous motor with a freewheel, i.e., a one-way clutch or with the aid of a motor having series-wound characteristics. This is because the motor with series-wound characteristics cannot act as a brake since there is no speed at which a generator effect can occur as long as the polarity between the armature and the field winding is not changed.

In addition, the universal motor operating in series-wound mode has a very gentle speed/torque characteristic.

Another supporting factor here is that the electronic control device which regulates the universal motor to a constant speed restricts or switches off the power supply to the universal motor when, owing to the oscillation of the load, the universal motor is accelerated to speeds above the desired speed.

Apart from these effects, the oscillation of the load is reduced in any case with a traveling gear that has a regulated universal motor as the drive since this type of drive reduces jerky accelerations.

The flexibility of the travel drive can be further increased if the switch arrangement has at least a third switching state in which power supply to the motor is possible. This third switching state can be assigned either another fixed speed of travel or the operating state of acceleration. This then enables the traveling gear to be operated at at least two different speeds of defined magnitude or else to be operated with continuously variable adjustment of the speed up to a maximum speed.

Whatever the type of motor, it is also possible, when required, to reverse the direction of travel if the traveling gear is to allow bidirectional operation. In this case, the switch arrangement is fitted either with just one or with two further switch positions in order to provide the same possibilities as regards the speed of travel in each direction of travel.

The switch arrangement can be operated remotely from a higher-order process control device, for example when the hoist travels in a largely automated system, but there is the possibility of switching the switch arrangement to the various switching positions by means of a manually operated actuating element. The latter case involves a push-button switch arrangement such as that customarily used in hoist control platforms.

Irrespective of whether a speed of travel that can be varied only in steps or continuously is possible, the traveling gear or the motor has a speed sensor which is connected to the electronic control device and which supplies the electronic control device with a signal proportional to the speed of travel.

Fundamentally, two different control systems come into consideration for the control of the series-wound motor. One consists in what is referred to as operating-angle control, which is advantageously used if the motor is to be fed from an AC system without prior rectification. The other possibility comprises a pulse-width-modulated controller which, admittedly, requires a DC voltage signal either at the input or in an intermediate circuit. Adjustment of the speed of the motor is then performed either by varying the operating or firing angle in the process of operating-angle control or the duty factor in the case of pulse-width modulation. Operating-angle control can also be regarded in the widest sense as a type of pulse-width modulation with a fixed clock frequency predetermined by the mains frequency. Using the equalization controller with pulse-width modulation, on the other hand, higher clock frequencies can be achieved and this may be of advantage where it is important to reduce the pulsed mains load.

Regulation of the speed of the motor in the case of a motor with series-wound characteristics can be performed either with the aid of a proportional controller or with the aid of an integral controller. The latter has the significant advantage that there is no residual error upon settling.

Although the controller can always be constructed using discrete physical components, it is expedient to implement the controller on the basis of a microprocessor, which means that the controller itself operates incrementally. It is nevertheless possible by means of a digitally implemented controller of this kind to produce control characteristics which can be implemented only with extraordinary difficulty with discrete components, if at all. In particular, it is easy with the aid of a digital controller to eliminate certain unpleasant properties of integral controllers such as a slow response or starting with the wrong initial value.

Thus, for example, it has proven advantageous if the controller is assigned an initial value which comes into effect automatically when the traveling gear is started from rest. This initial value does not necessarily have to be identical with the steps by which the value of the controller or the state of the controller is incremented when the desired regulation in the sense of holding the speed constant or reaching a desired speed is activated after operation is first switched on.

Since the current-flow angle generally increases more rapidly than the traveling gear can accelerate, the current-flow angle will be greater when the nominal speed is reached than that required to hold this speed constant, once reached. In order to suppress severe overshooting of the speed of travel, which can be caused by the time constant of the controller, the state of the controller is expediently reduced after the first overshoot of the desired speed, the reduction being by a value which is, in turn, expediently higher than the incremental value with which the controller otherwise operates in normal operation.

In other words, the controller operates with different or larger jumps than in normal operation when a change in the operating situation caused in the final analysis by a change in the switch position occurs.

If the traveling gear is to operate with a speed of travel which is largely continuously variable, use is made of a desired-value generator which can assume different values depending on the switch position. In the case of acceleration from rest or an existing speed of travel, the desired-value generator is set to a value which corresponds to the maximum possible speed or a higher speed. As soon as the user or the system controlling the hoist from a higher hierarchical plane detects that the desired speed of travel has been reached, the value of the desired-value generator is reset to the actual speed value, so that the controller can then orient itself with reference to this desired value until the next adjustment is performed. The same applies, of course, mutatis mutandis in the case of deceleration, i.e. reduction of the speed of travel in the direction of a lower speed.

In addition, further developments of the invention are the subject-matter of subclaims.

BRIEF DESCRIPTION OF THE DRAWINGS

Exemplary embodiments of the subject-matter of the invention are illustrated in the drawing, in which.

DETAILED DESCRIPTION OF THE PREFERRED EMBODIMENTS

Figure 1:
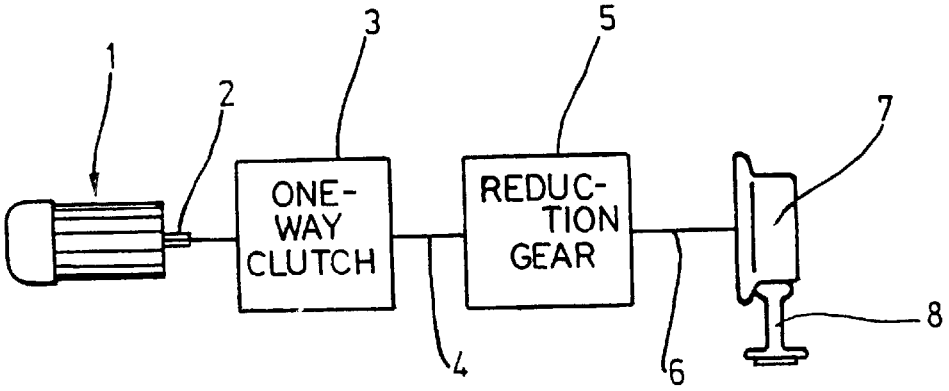
FIG. 1 shows a diagrammatic representation of a traveling gear with an asynchronous motor for substantially suppressing oscillation of the load.

FIG. 1 shows, in a diagrammatic representation, a mechanical embodiment of a drive system for the traveling gear of a hoist, for example a trolley traveling gear, as used in overhead conveying apparatus. The drive system has an asynchronous motor 1 which runs in only one direction and the output shaft 2 of which is mechanically coupled to a schematically represented freewheel 3, i.e., a one-way clutch. On the output side, the one-way clutch or 3 is connected to an input shaft 4 of a reduction gear 5, the output shaft 6 of which is in turn coupled in torsionally rigid fashion to one of the driving wheels 7. Driving wheel 7 runs on a schematically represented running rail 8.

The driving device described operates as follows:

When a control switch (not shown) is operated to supply the drive motor 1 with electrical energy, it begins to rotate in the direction of rotation predetermined by its design. Via the one-way clutch or freewheel 3, which provides frictional coupling in this direction, it drives the input shaft 4 of the gear 5, which then sets in motion the driving wheel 7. Owing to the relatively high starting torque of the asynchronous motor 1, the traveling gear 5 is accelerated in a relatively abrupt manner. The load hanging from the load-carrying means in the form of a rope, cable or chain cannot keep up with this sharp acceleration and, as a result, it will initially trail behind the traveling gear. After a time dependent on the conditions, the asynchronous motor 1 reaches its nominal speed, which means that the traveling gear will from then on travel at a constant speed along the running rail 8. The load, which initially lags behind the movement of the traveling gear, forms a pendulum under the traveling gear travelling at constant speed, said pendulum being deflected by the jerky starting movement and swinging with the time constant characteristic of it, which depends on the length of the load-carrying means which has been paid out and the mass of the load hanging from it. In accordance with this time constant, the load swinging in the direction of travel will catch up with the traveling gear after said traveling gear has traveled a corresponding distance, in the sense that the load will be directly under the traveling gear. Up to this time, the swinging load has exerted a retarding force on the traveling gear. Beginning with the instant at which the load is under the traveling gear and from then on, since the load overtakes the traveling gear in such a way as to move ahead of it, the load will exert a pulling force on the traveling gear with a tendency to accelerate the traveling gear.

The asynchronous motor 1 cannot keep up with this acceleration because it can accelerate only up to the synchronous speed, which, in practice, is just a few percent below the speed under load which occurs during the driving of the traveling gear. In this operating situation, the one-way clutch or freewheel 3 disengages and thus allows the traveling gear to follow the forward-swinging load. In the process, the forward-swinging load will feed part of its oscillation energy into the traveling gear as propulsive energy. The result is that the pendulum formed by the load is not as far, at the point of reversal, from the zero position, in which the load would be directly under the traveling gear, as would be the case if the drive train between the wheel 7 and the motor 1 had not disengaged. As a result of the automatic disengagement of the one-way clutch or freewheel 3, the traveling gear pulled along by the load has absorbed part of the oscillation energy.

As a result, the entire oscillation energy can be damped out in a small number of oscillation cycles without the need for measures involving control technology. The oscillation damping here takes place during each forward swing, i.e. that half of the oscillation in which the load tends to move ahead of the traveling gear, because it is during this half-wave that the oscillation energy is converted into driving energy for the traveling gear. During this phase, the motor 1 itself does not supply any propulsive energy. Since the pendulum must always swing symmetrically with respect to the zero position (it cannot stay permanently in an oblique position in space), the amplitude in the return stroke is at most equal to the amplitude during the immediately preceding forward swing.

Without the one-way clutch or freewheel 3 situated in the drive train between the motor 1 and the driving wheel 7, the oscillation damping achieved would be nowhere near as effective since, in that case, the pendulum would be as it were rigidly mounted and could not transfer any energy to its mounting. The situation is otherwise with the use of the one-way clutch or freewheel 3, giving rise to a drive arrangement which would correspond to a pendulum mounted in a manner which produces damping.

The purely mechanical solution shown in FIG. 1 is the preferable solution for monorail conveyors, where the traveling gears travel along a continuous track and always in the same direction. If reversal of the direction of rotation is required, the direction of action of the one-way clutch or freewheel 3 must be reversed to match the direction of travel, in particular in such a way that a force acting on the traveling gear in the direction of travel must be able to accelerate the traveling gear and, in doing so, be genuinely decoupled from the motor 1.

Figure 2:
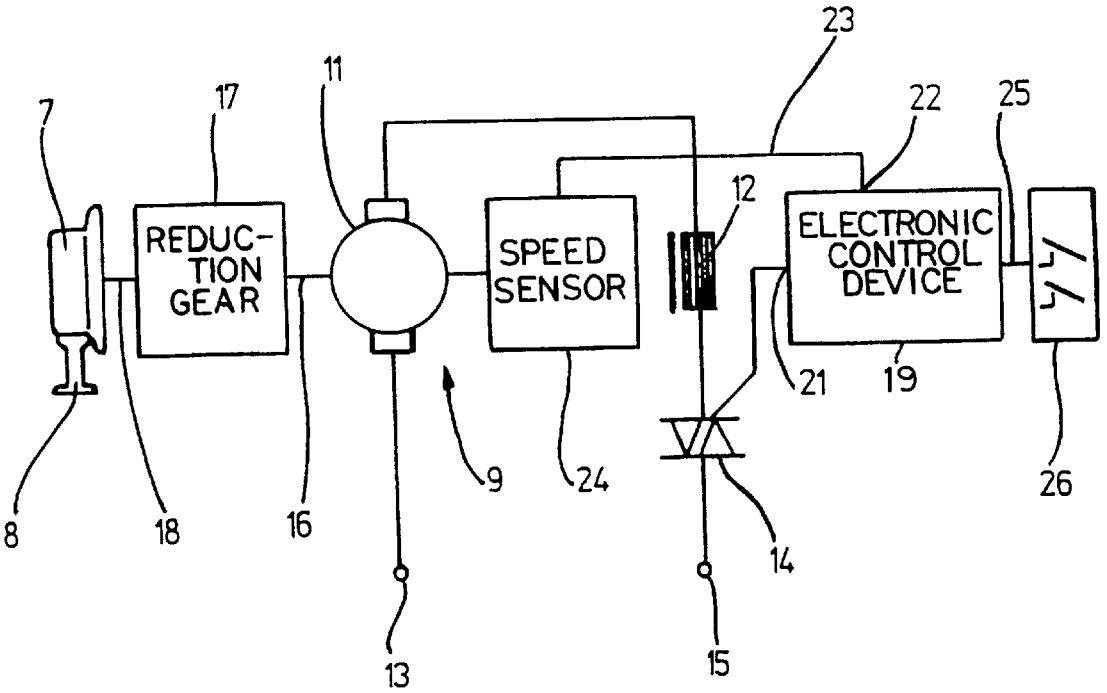
FIG. 2 shows a diagrammatic representation of a traveling gear with a motor with series-wound characteristics for suppressing oscillation of the load.

FIG. 2 shows an embodiment of the novel driving device in which the mechanical one-way clutch or freewheel 3 is as it were simulated electrically.

The drive motor in the embodiment shown in FIG. 2 is a universal motor 9 operating in series-wound mode comprising an armature 11 and an associated field winding 12. The armature 11 is connected by a connection terminal to a phase conductor 13 of an AC system, while another terminal of the armature 11 is connected to one end of the field winding 12. The other end of the field winding 12 is connected via a triac 14 to another phase conductor 15 or to a neutral conductor of the AC system. The armature 11 drives an input shaft 16 of a reduction gear 17, the output shaft 18 of which, in turn, is connected in torsionally rigid fashion to the driving wheel 7 of the traveling gear.

The triac 14 is controlled by means of an electronic control device 19, the output 21 of which supplies trigger pulses to the gate of the triac 14. The control device 19 has an input 22 which is connected by a connecting line 23 to a speed sensor 24. The speed sensor 24 is coupled in torsionally rigid fashion to the armature 11.

The control device 19 is actuated by means of a schematically indicated switch arrangement 26 connected to an input 25. This switch arrangement 26 can optionally be a manually actuated push-button switch arrangement or can represent signals which come from a higher-order control device and actuate or control the control device 19. For the sake of simplicity, it will be assumed that the switch concerned is a push-button switch which is operated by the user of the hoist concerned.

The way in which the arrangement shown in FIG. 2 operates will be explained below, with the assumption that the switch arrangement 26 has just two positions, namely a neutral or zero position and a driving position.

In the neutral or zero position, the control device 19 does not emit any trigger pulses to the triac and, as a result, the circuit passing through the motor 9 remains interrupted.

If the user wishes to put the traveling gear of the hoist into operation, he actuates the push-button switch 26, i.e. he moves the switch to the driving position. As a result, the control device 19 receives a corresponding signal at its input 25 and, from then on, begins to supply the gate of the triac 14 in a known manner with trigger pulses synchronized with the alternating voltage of the mains. With each first trigger pulse for the triac 14, the latter switches to the conducting state and continues to be conducting until the alternating voltage of the mains and, associated with the latter, the current through the universal motor 9 also disappears. At this time, the triac 14 turns off and remains blocked during the next half-wave until it receives another trigger pulse from the control device 19 at its gate.

The position of the trigger pulses relative to the respectively preceding zero points of the alternating mains voltage, also referred to as the operating or firing angle, determines how much power the universal motor 9 can take from the mains. The control device 19 acts as a regulator and regulates the operating or firing angle in such a way as to stabilize the speed of the universal motor 9, for which purpose it detects the armature speed of the latter by way of the speed sensor 24. The control device 19 is thus, in the widest sense, a regulator, which, given an appropriate signal at its input 25, adjusts the electric power fed to the universal motor 9 in such a way that the universal motor 9 runs at the predetermined speed.

Because of this behavior of the control device 19, the operating angle for the universal motor 9 becomes small and, consequently, the current-flow angle becomes large when the motor is subjected to load and its speed is in danger of falling and, conversely, the operating angle becomes large and, hence, the current-flow angle becomes small when the speed of the universal motor 9 shows a tendency to increase because of an acceleration or relief of load.

With the traveling gear at a standstill, the imagined user has moved the push-button switch 26 into the driving position. Since the sensor 24 reports a zero speed to the control device 19, it will initially operate the triac 14 with a very small operating angle to ensure that the universal motor 9 can take a large amount of electrical power from the mains in order to accelerate the traveling gear. As its speed approaches the desired speed, the control device 19 begins to increase the operating angle, leading to a reduction in power consumption from the mains which continues until the nominal speed is reached.

As already described above, the start-up process will lead to the load trailing behind the traveling gear, i.e. the pendulum formed by the load is deflected counter to the direction of travel. As soon as the universal motor 9 has reached its nominal speed, which is established by means of the control device 19, further acceleration of the oscillating load ceases. The pendulum oscillation will now take place in the direction of travel. As soon as the pendulum formed by the load has gone beyond its zero position, in which the load is directly vertically under the traveling gear or, in other words, the load-carrying means is aligned parallel to the gravitational vector, and begins to move forward ahead of the traveling gear in the direction of travel, the load tends to pull the traveling gear behind it. The electrical properties of the universal motor 9, operating in series-wound mode, in conjunction with the control device 19 now act as did the freewheel 3 in the exemplary embodiment shown in FIG. 1 in that they allow the traveling gear to be driven by the load. The leading load tends to pull the traveling gear and thus leads to output-side relief of the load on the motor 9, which consequently have to supply less driving energy.

Without the intervention of the control device 19, this reduction in the driving energy would not take effect. Instead, the universal motor 9 would continue to increase its speed when relieved of load if the power received previously from the network were to remain constant. However, the regulation by the control device 19 counteracts this in that it increases the operating angle so as to prevent the acceleration of the traveling gear which would be caused by the interaction of the forward-swinging load and the drive motor. Since the universal motor 9 is now supplying less driving power, the energy required for driving must be supplied from the oscillation energy and, in addition, the traveling gear is following behind the load, which means that the pendulum is damped during the phase of the forward swing.

This effect is considerably assisted by the series-wound characteristics of the universal motor 9, which has a hyperbolic speed/torque characteristic and in which there is no limiting speed above which it could act as a generator and thus have a braking effect on the traveling gear. Any stabilization of the traveling speed in the sense of locking of the traveling speed would prevent oscillation damping. Since, however, the series-wound motor cannot act as such a brake, the load swinging forwards in the direction of travel and overtaking the traveling gear is able to drag the traveling gear behind it, thereby reducing the forward-directed amplitude. The term forward-directed amplitude is here taken to mean the maximum deflection relative to the zero position, which occurs at the point of reversal. In the zero position, the load is directly under the traveling gear and the load-carrying means, i.e. the rope, cable or chain, runs parallel to the gravitational vector.

A significant advantage of the arrangement shown in FIG. 2 is that no mechanical freewheel is required. Instead, relatively inexpensive electronic components, which take up little space, are used to simulate the freewheel characteristics. The distances which a trolley traveling gear has to travel during its life are not so great that the commutator present in a universal motor and its life represent a constraint.

Figure 3:
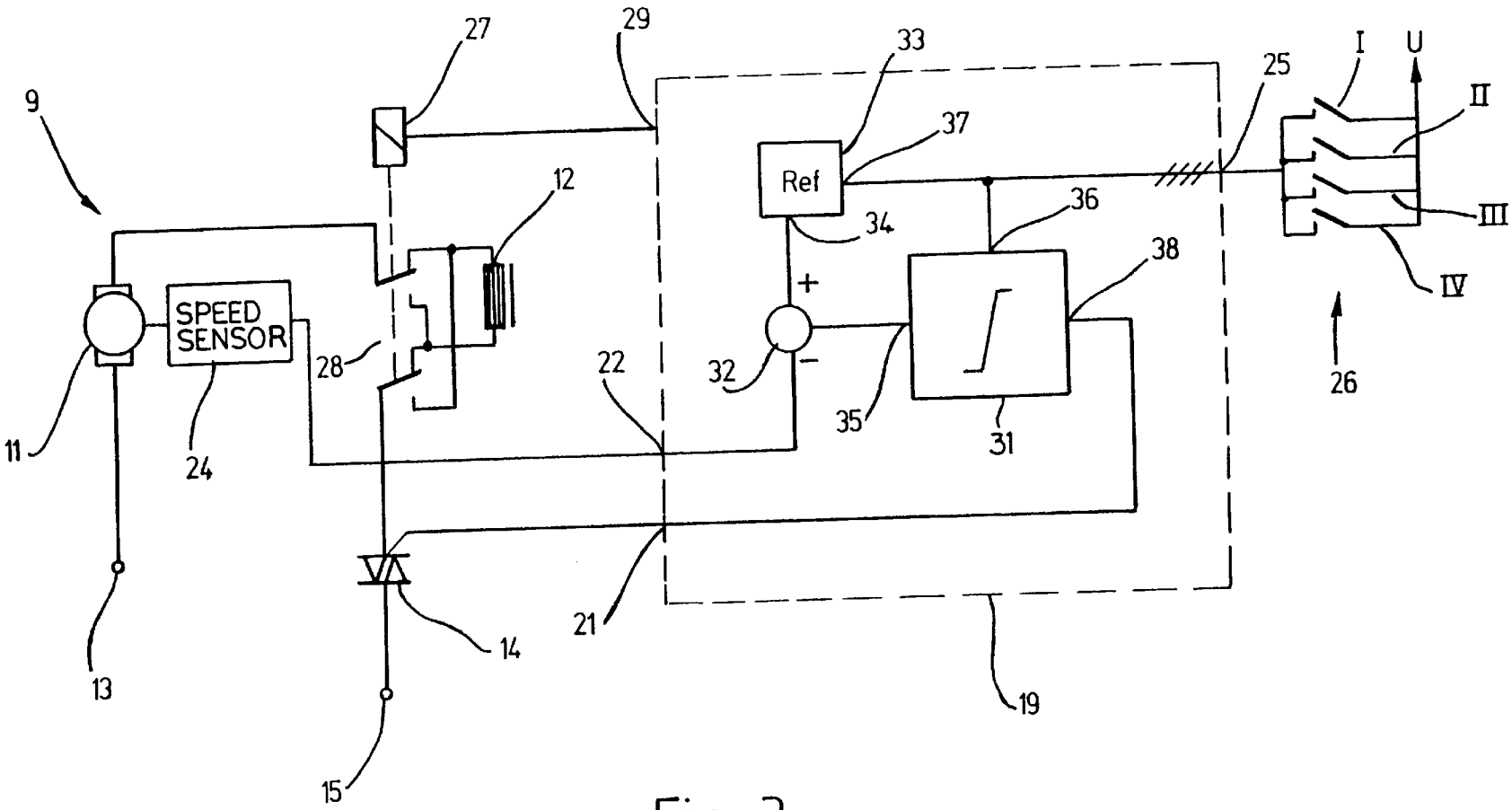
FIG. 3 shows a circuit diagram for the drive system shown in FIG. 2.

It is furthermore possible, by adding another switch set, to change the direction of rotation of the universal motor at any time, thus making possible travel in both directions. It is sufficient for this purpose if the field winding 12 as shown in FIG. 3 is connected electrically in a known manner, via a polarity reversal device, to the armature 11 in order to change the direction of rotation of the universal motor 9. A supplementary feature of this kind makes it possible to set the traveling gear in motion in both directions, as desired, and the oscillation-damping properties of the novel drive concept take effect in both directions.

Finally, a significant advantage of the arrangement shown in FIG. 2 is that it is comparatively simple to construct traveling gears with a number of speeds or else continuously variable adjustment of the speed, as explained below.

It may be assumed for this purpose that the control device 19 is a microprocessor which is capable of supplying the desired mains-synchronous trigger pulses at its output 21 to the triac 14 and is furthermore connected via its input 25 to a switch set. As above, this switch set has a neutral or zero position, a first position, which corresponds to a creep speed, and a second position, which corresponds to the fast speed, the traveling gear running in the same direction in the case of both switch positions. There is furthermore a third and a fourth switch position, which serve to move the traveling gear in the opposite direction at the normal or the fast speed.

FIG. 3 shows the associated block diagram, each switch position I to IV here being assigned its own switch set, while the zero or neutral position corresponds to an operating situation in which all switches are open simultaneously.

To the extent that components already described occur again in the circuit arrangement shown in FIG. 3, they are provided with the same reference numerals and are not described again.

In the arrangement shown in FIG. 3, the field winding 12 is connected via a reversing switch 28 actuated by a relay winding 27 into the series circuit comprising the armature 11 and the triac 14. The control device 19 is essentially a microprocessor, which may be expanded by the power output stages required, which are not indicated to preserve simplicity, since they are of no significance for the understanding of the invention.

The switches, denoted I to IV, corresponding to the individual circuit states are connected to the input 25, which has four separate individual lines. These switches are intended to represent the different signal states at the input, the abovementioned relationship applying. They are connected at one end to a common DC forward supply voltage U.

In addition to that those in the exemplary embodiment shown in FIG. 2, the control device 19 has another output 29, via which the relay winding 27 is controlled to allow the direction of rotation of the universal motor 9 to be changed.

By means of the microprocessor used to embody the control device 19, a PI controller 31, a desired/actual value comparator 32 and a switchable reference 33 are implemented.

One input of the desired/actual value comparator 32 is connected to input 22, while the other input is connected to an output 34 of the reference. The output signal obtained from the comparator 32 enters an input 35 of the PI controller 31, which, like the reference at its input 37, is controlled at an input 36, by means of signals coming from input 25.

Finally, the PI controller 31 has a further output 38, which is connected to the output 21 of the control device 19.

Figure 4:
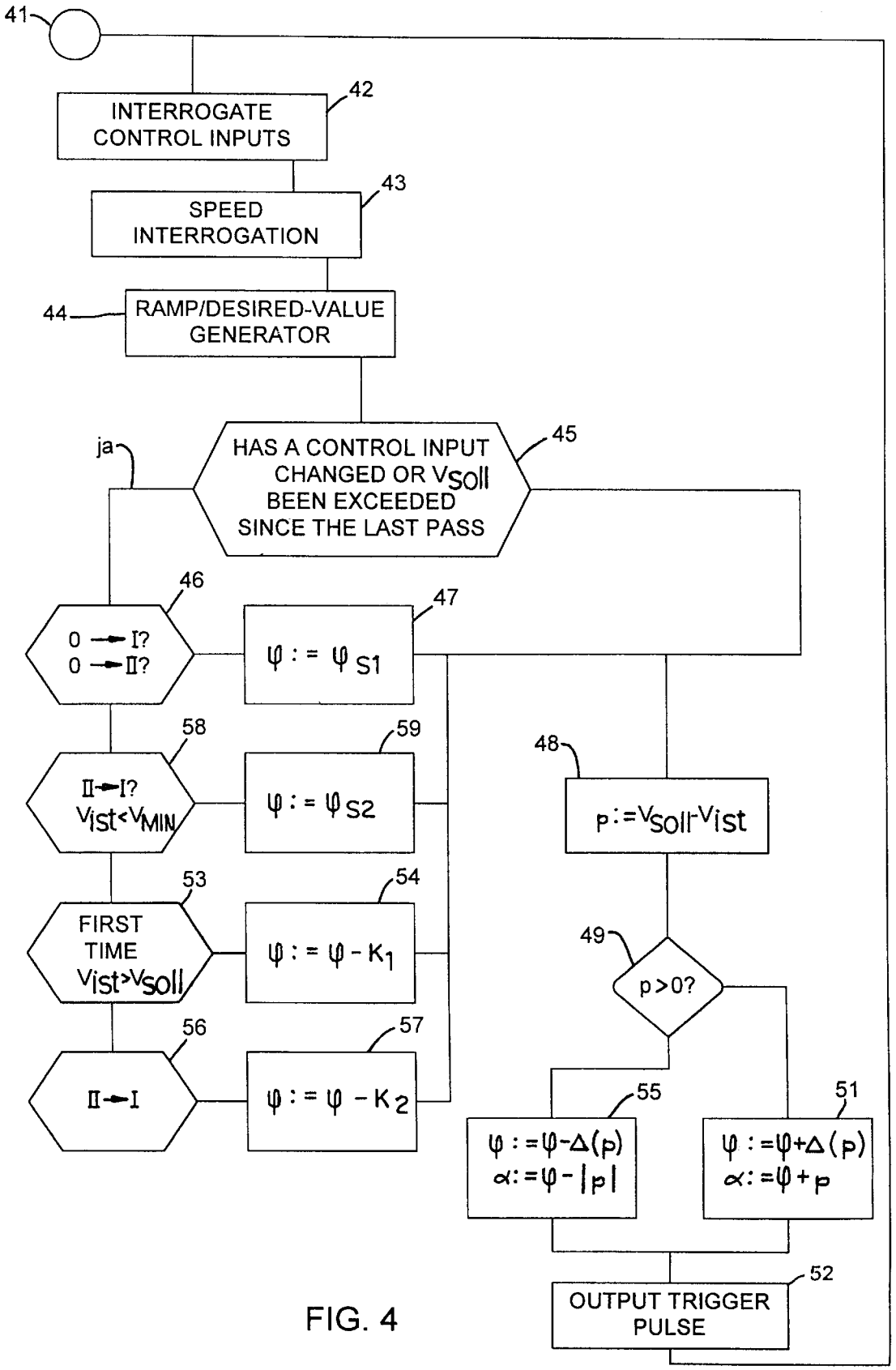
FIG. 4 shows a flow diagram relating to the control of the traveling gear shown in FIG. 2
Figure 5:
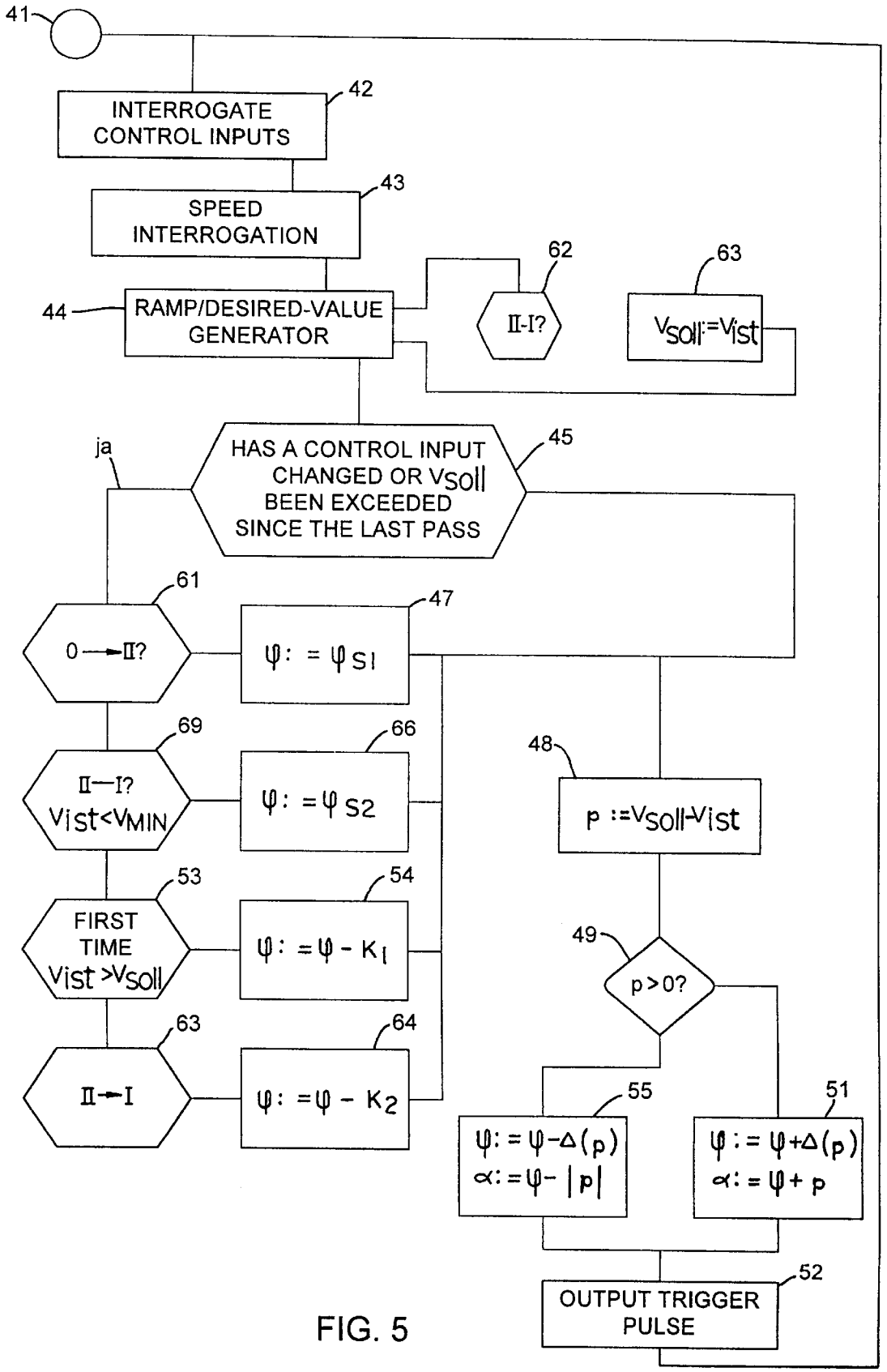
FIG. 5 shows diagrams relating to the current-flow angle and the traveling speed in different operating situations.

The functions of the reference 33 of the comparator 32 and the PI controller 31 are performed by program sections in the microprocessor. FIG. 5 shows the flow diagram which illustrates that section of the overall program of the microprocessor which is implemented to control the motor 9 in the desired manner. With the aid of this program in accordance with the flow diagram shown in FIG. 4, the device operates as follows:

While none of the switches I to IV is actuated, the flow diagram shown in FIG. 4 is not executed. Only the actuation of one of the switches I to IV or the supply of a corresponding control signal leads to the microprocessor starting a program corresponding to the flow diagram shown in FIG. 4. The program is begun at 41 and, at a program location 42, enquires which of the switches I to IV has been actuated. This actuation state is stored and the program then continues and, at 43, interrogates the input 22 at which a signal characterizing the speed of the universal motor 9 is supplied by the speed sensor 24. The actual speed $v_{ist}$ is stored and the program continues to program location 44, at which a reference speed is generated with which the actual speed is compared.

The parameter for this ramp generator for controlling the actual speed is the actuated switch and the time which has passed since the actuation of the switch. In the description which follows, it will be assumed that switch I is assigned a normal speed in the forward direction, switch II is assigned a fast speed in the forward direction, switch III is assigned a normal speed in the reverse direction and switch IV is assigned the fast speed in the reverse direction.

Depending on which of these switches has been actuated, the ramp generator runs up gradually over a number of program passes, either until a speed corresponding to the normal speed is reached or until a speed corresponding to the fast speed is reached.

After the definition or updating of the reference variable $v_{soll}$, the program enquires at branch point 45 whether the state at input 25 has changed at this point since the last pass or whether the switch position has been changed or whether the reference value $V_{soll}$ has been exceeded for the first time after a preceding change in the switch.

In the explanation which follows, it will be assumed that switch I has been actuated for the first time, this corresponding to start-up from a standstill and acceleration up to the normal speed. The program therefore proceeds to branch point 46, at which it checks whether there has been a change from the state of no switch actuation to the state of actuation of switch I or switch II. For the reverse direction, the values III and IV are of course applicable, as appropriate, at this point. If the result of this check is positive, i.e. a change of state corresponding to an acceleration from a standstill has taken place, the program proceeds to an instruction block 47, at which an integral component $\phi$ for the current-flow angle is set to a predetermined starting value $\phi_{s1}$. A fixed current-flow angle, corresponding to a largely jerk-free but sufficiently rapid start-up from stationary is thereby set for the starting phase from a standstill.

The program then continues to an instruction block 48. In 48, the program calculates the difference between the reference value $V_{soll}$ and the actual speed $v_{ist}$ and, from this, obtains an error parameter p.

This calculation is followed, in 49, by a branch depending on whether the error parameter p is greater than zero or not. If the error parameter p is greater than zero, this means that the actual speed is still lower than the desired speed or that the electric power fed to the universal motor 9 is not yet sufficient to bring the travel drive up to the desired speed. In an instruction block 51, the current-flow angle $\phi$ is therefore increased by $\Delta$ and stored again. Here, the incremental value $\Delta$ itself can be a function of the error parameter p or else constant.

Since the controller 31 acts as a PI controller, there remains a proportional component to be added to the current-flow angle $\phi$ representing the integral component. The actual current-flow angle $\alpha$ is obtained from this by adding the error parameter p or a variable derived from it to the integral component $\phi$ of the current-flow angle.

After the current-flow angle $\alpha$ composed of the integral and the proportional component has been calculated in this way, the current-flow angle $\alpha$ is converted, in 52, into the time at which, in relation to the preceding zero point of the alternating mains voltage, the trigger pulse for the triac 14 must be emitted to obtain the desired current-flow angle. The program then returns to block 42 and checks whether the position of the switches I to IV has changed in the interim. Assuming that no change has been observed, the stored state relating to switch actuation is maintained and the program can interrogate the actual speed $V_{ist}$ again in 43 and update the corresponding stored variable.

Since, as mentioned, the parameter for the desired speed $V_{soll}$ is increased with time up to the value corresponding to the relevant switch actuation I or II or, where relevant III or IV, the value of the reference variable $V_{soll}$ rises gradually over successive passes.

As assumed at the beginning, there has been no change in the switch actuation and the traveling gear is furthermore still in the acceleration phase, i.e. $V_{ist}$ is lower than the target speed specified by the switch actuation. The program will therefore continue directly via block 48 and, in block 51, will increase the integral component of the current angle incrementally while, on the other hand, the error parameter p will grow gradually smaller because the difference between $V_{ist}$ and $V_{soll}$ will decrease in corresponding fashion.

After a multiplicity of passes of the type described, the time will arrive at which the ramp generator supplies a reference value $V_{soll}$ equal to the target speed at which the traveling gear is supposed to travel in accordance with switch actuation I. From then on, the ramp generator supplies a constant reference value $V_{soll}$ in 44 until the switch positions at input 25 change.

During the acceleration phase, there will likewise arise for the first time, after a number of passes of the program loop described above, the situation that the actual speed $V_{ist}$ will exceed the reference speed $V_{soll}$. In general, current-flow angle $\alpha$ is greater at this time than that required for travel at the constant speed $V_{soll}$ because of the preceding acceleration phase, even though the proportional component p has fallen almost to zero in the meantime. This controller situation with too large an integral component $\phi$ would lead to an unwanted overshoot in the speed of travel, for which reason the program does not pass directly to the block 48 at 45 but, after comparing the desired value with the actual value, continues in the left-hand part at 53, where a branch to an instruction block 54 is provided. In instruction block 54, the integral component of the current-flow angle $\phi$ is reduced abruptly by a larger amount than $\Delta$ by subtracting from the integral component of the current-flow angle $\phi$ a fixed quantity $K_1$. After this arithmetic operation, the program continues as already described at 48.

If, during the next pass through the loop, the actual speed is still higher than the desired speed, then the program once more continues at branch point 45 as it did originally at 48 since it is not the first time the reference speed $V_{soll}$ has been exceeded after a preceding change in the switch positions. Since, in this operating situation, the actual speed is still higher than the desired speed, the error parameter will be negative, for which reason the program does not pass from branch point 49 to instruction block 51 but to an instruction block 55. In this instruction block 55, the integral component of the current-flow angle $\phi$ is reduced incrementally by $\Delta$, which can, in turn, be a function of p or have a constant value. In the next line, the integral component $\phi$ is reduced by the amount of the error parameter p or a quantity derived from the latter in order to obtain the true current-flow angle $\alpha$, which is then, in turn, converted into the correspondingly emitted trigger pulse at program location 52.

In the steady-state phase, the program described by means of a sketch in FIG. 4 is run continuously as before. The speed of travel will oscillate continuously around the desired speed, for which reason the program will alternately continue via instruction block 51 and instruction block 55 after branch point 49.

The freewheel characteristics mentioned at the outset are achieved by the fact that the desired speed is exceeded during the forward swing of the load and hence during the time when the traveling gear is being dragged by the oscillating load, and this has the effect that the PI controller runs via instruction block 55 and increasingly reduces the integral component $\phi$. The current-flow angle becomes correspondingly smaller, ie. the propulsive energy for the traveling gear comes from the pulling load.

To halt the traveling gear, the user releases all the switches, thereby ending the execution of the program shown in FIG. 4.

A number of other variants must also be considered in addition to the functions described. One variant is the actuation of switch II, i.e. start-up and subsequent acceleration up to the fast speed. This measure has a discernible effect essentially only in the region of the desired-value generator at 44 in that the reference parameter $V_{soll}$ is there raised to the target speed corresponding to the fast speed. In other respects, the program behaves as described above since, upon being first started, it runs from the zero state via branch point 46 and instruction block 47, as hitherto.

The next variant to be considered is the actuation of switch II after switch I has already been actuated and the traveling gear is moving at the normal speed. This corresponds to acceleration from the normal speed to the fast speed.

In order to avoid here the displeasing slow control characteristics of the integral controller, the program passes from branch point 45 to a branch point 56 in the first pass following the actuation of switch II. This branch point 56 is followed by an instruction block 57, where the integral component $\phi$ is increased abruptly by a constant $K_2$. Following this, the program behaves as described initially.

The last variant to be considered is the switch back from switch position II to switch position I, i.e. slowing of the speed of travel from the fast speed to the normal speed. During the first pass through the loop following such a change of state, the program passes at branch point 45 into the left-hand branch shown in FIG. 4, to a branch point 58 in which a check is made to determine whether the actual speed is higher than the desired speed, which will in general always be the case when switching back, whereupon the program will return via an instruction block 59 to instruction block 48 in the normal part of the progam. In instruction block 59, the integral component $\phi$ is set to a new initial value $\phi_{s2}$ which is smaller than corresponds to travel at the normal speed.

The person skilled in the art will know how to convert switch positions III and IV into the reverse-operating mode and there is therefore no need for a more detailed description of this. The control program, on the other hand, is the same as that explained in conjunction with switch positions I and II.

Apart from a stepwise switchover of the speed of travel, it is also possible to vary the speed of travel in a continuously variable manner. In this case, a program corresponding to the flow diagram shown in FIG. 5 is used. Insofar as branch points and instruction blocks which have already been explained occur here, they are provided with the same reference numerals as in the flow diagram shown in FIG. 4 and are not described again.

The essential difference is that switch position I and switch position III correspond to a state in which the traveling gear is intended to continue on at the speed of travel reached at the switchover time. Switch position II and, accordingly, also switch position IV, on the other hand, signify start-up or acceleration of the traveling gear for as long as this switch state is maintained or until a maximum permissible speed of travel is exceeded.

Taking into account these changed meanings of switch positions I to IV, the program operates as follows:

To start from a standstill, the user must achieve switch position II or IV, i.e. the reference value $V_{soll}$ is set in the ramp generator to a maximum value $v_{max}$ in the course of a number of loop passes. This response in block 44 corresponds to this extent approximately to the response of block 44 in FIG. 4.

Since the traveling gear has been started from a standstill, i.e. switch II has been actuated for the first time, the program branches at interrogation point 45 into the left-hand part, to an interrogation point 61 which corresponds essentially to interrogation point 46 in FIG. 4. If the condition forming the criterion there is met, the integral component $\phi$ of the current flow angle is set to a starting value $\phi_{S1}$ and the program continues with interrogation block 48, from where its behavior is the same as that explained in connection with FIG. 4.

Assuming that the user observes during the acceleration phase that the traveling gear is now moving at the desired speed, he will switch to state I. This has the result that at the ramp generator 44 a branch at 62 is executed in such a way that the measured actual value $V_{ist}$ is adopted as the reference value $V_{soll}$. In other words, the actual speed of travel reached at the switchover time becomes the reference value about which the speed of travel is then subsequently to be regulated. However, this updating or adoption process takes place only if the program detects the switch from state II to state I, but not if state I persists.

At branch point 45, the switchover from state II to state I is likewise detected again and, as a result, the program once more branches into the left-hand branch and passes to interrogation point 63. Here the program ensures that the integral component $\phi$ is reduced abruptly by a constant $K_2$ because, during the preceding acceleration phase, the current-flow angle has reached values which are greater than those required for travel at the constant speed. The abrupt change in the integral component $\phi$ avoids an unnecessary overshoot in the speed of travel when the user switches back from state II (=acceleration) to state I (=maintain speed). As a result, the controller settles more rapidly.

After the abrupt change in the integral component $\phi$ in block 64, the program returns to instruction block 48 and, in other respects, behaves as described in detail in connection with FIG. 4.

If there is to be a further acceleration from the maintained speed, this only has effects on the behavior of the ramp generator at 44 insofar as the reference value is increased again up to the maximum speed. A further consequence is that, after the branch at 45, the program reaches an interrogation 65 which leads to an instruction block 66 that ensures that the integral component $\phi$ is increased abruptly to $\phi_{s2}$ to ensure that rapid acceleration can be achieved.

After this, the program shown in FIG. 5 behaves in exactly the same way when the first overshoot of the reference speed occurs as the program shown in FIG. 4.

A travel drive for a trolley traveling gear of hoists has a drive train which has freewheel characteristics as regards the direction of travel. Consequently, load oscillation can be rapidly damped out because the speed of the traveling gear is not forcibly held constant during the semioscillation of the load in which it moves ahead of the traveling gear. On the contrary, the swinging load is able to drag the traveling gear behind it, accelerating it in the process, and in this way to convert oscillation energy into driving energy.

We claim:

1. An electric drive for a traveling gear of a hoist comprising:

an electric drive system which is kinematically connected to at least one wheel of the traveling gear, the electric drive system including a power source and means, operatively coupled to the power source, for at least simulating a one-way clutch so that, in the case of an externally acting force that tends to accelerate the traveling gear, essentially no power is transmitted from the drive system to the wheel.

2. The electric drive as claimed in claim 1, wherein the power source comprises a universal electric motor which is kinematically connected to the wheel of the traveling gear, and further comprising 1) at least one signal-generating arrangement, which has at least a first state and a second state, the first state corresponding to the switching off of the power supply to the universal motor and the second state requesting a power supply to the universal motor, and 2) an electronic control device to which the signal-generating arrangement is connected and which has an electrically controllable switch which is situated in a power supply conductor leading to the universal motor, the electronic control device keeping the controllable switch switched off in a first state when the signal-generating arrangement is in the first state and, in a second state, actuating the electronic switch in such a way as to stabilize the speed of traveled when the signal-generating arrangement is in the second state.

3. The electric drive as claimed in claim 2, wherein the universal motor is a series-wound motor.

4. The electric drive as claimed in claim 2, wherein the signal-generating arrangement has a third control state in which power supply to the universal motor is requested.

5. The electric drive as claimed in claim 2, wherein the electronic control device has a third operating state in which it actuates the electronic switch.

6. The electric drive as claimed in claim 2, wherein the electronic control device actuates the electronic switch to hold constant a first speed when the signal-generating arrangement is in the second state, wherein the signal-generating arrangement has a third state, and wherein the electronic control device actuates the electronic switch to hold constant a second speed when the signal-generating arrangement is in the third state.

7. The electric drive as claimed in claim 6, wherein the second speed is higher than the first speed.

8. The electric drive as claimed in claim 7, wherein the second state requests driving of the universal motor in a forward direction, and wherein the signal-generating arrangement has a fourth state which requests driving of the universal motor in a reverse direction at a third speed which is commensurate with the first speed.

9. The electric drive as claimed in claim 8, wherein a desired-value generator of the electric control device is set to a value which corresponds to a zero speed when the signal-generating arrangement is switched to the first and wherein the desired-value generator is set to a value which corresponds to the actual speed when the signal-generating arrangement is switched back from the first state to the second state or the fourth state.

10. The electric drive as claimed in claim 7, wherein the signal-generating arrangement has a fifth state which requests driving of the universal motor in the reverse direction at a fourth speed which is commensurate with the second speed.

11. The electric drive as claimed in claim 10, wherein a desired-value generator of the electric control device is set to a value which corresponds to a maximum possible or higher speed when the signal-generating arrangement is switched to the third state or the fifth state, and wherein the desired-value generator which corresponds to the actual speed when the signal-generating arrangement is switched back from the third state or the fifth state to the second state or the fourth state.

12. The electric drive as claimed in claim 2, wherein the electronic control device includes means for reversing the direction of rotation of the universal motor.

13. The electric drive as claimed in claim 2, wherein the signal-generating arrangement is a switch arrangement.

14. The electric drive as claimed in claim 2, wherein the switch arrangement includes a manually operated switch arrangement.

15. The electric drive as claimed in claim 14, wherein the first state of the switch arrangement corresponds to a neutral position of the actuating element.

16. The electric drive as claimed in claim 14, wherein the second and third states of the switch arrangement correspond to deflected positions of the actuating element, the second state lying closer to a neutral position than the third state.

17. The electric drive as claimed in claim 2, further comprising a speed sensor which is connected to the electronic control device and to a monitored device comprising one of the universal motor and the traveling gear and which transmits a signal proportional to the speed of the monitored device to the electronic control device.

18. The electric drive as claimed in claim 2, wherein the electronic control device transmits an operating angle control signal to the universal motor.

19. The electric drive as claimed in claim 2, wherein, when power is being transmitted to the traveling gear from the universal motor, the electronic switch is supplied with a train of pulses, a duty factor of the pulse train being dependent on 1) a command speed selected by way of the signal-generating arrangement, 2) a resistance to motion, and 3) an oscillation position of a load hanging from the hoist.

20. The electric drive as claimed in claim 2, wherein the electronic control device contains a proportional controller.

21. The electric drive as claimed in claim 20, wherein the controller has an initial value which corresponds to at least one predetermined duty factor of the pulse train and a current-flow angle.

22. The electric drive as claimed in claim 2, wherein the electronic control device contains an integral controller.

23. The electric drive as claimed in claim 2, wherein a controller of the electronic control device operates incrementally, and wherein one current-flow angle or duty factor corresponds to each state of the controller.

24. The electric drive as claimed in claim 23, wherein, in the event of a change in operation of the universal motor caused by a change of state of the signal-generating arrangement, the state of the controller is changed abruptly at least once as a departure from its normal operation.

25. The electric drive as claimed in claim 24, wherein the abrupt change consists in the electronic control device setting the controller to an initial value if (i) the traveling gear is to be started from rest or (ii) upon switching back from a second speed to a first speed, a predetermined speed is reached.

26. The electric drive as claimed in claim 25, wherein the electronic control device has at least one desired-value generator, wherein the electronic control device includes means for comparing a signal proportional to the speed of the universal motor to the desired value, and wherein the controller increases the current-flow angle incrementally until the speed is higher than the desired value.

27. The electric drive as claimed in claim 24, wherein the electronic control device has at least one desired-value generator, wherein the electronic control device includes means for comparing a signal proportional to the speed of the universal motor with the desired value, and wherein the abrupt change consists in subtracting a predetermined increment that differs from increments in normal operation from the value of the controller when the desired value is exceeded for the first time after an acceleration phase.

28. The electric drive as claimed in claim 1, wherein the electronic control device has at least one desired-value generator, wherein the electronic control device includes means for comparing a signal proportional to the speed of the universal motor with the desired value, and wherein a controller reduces the current-flow angle incrementally until the speed is lower than the desired value.

29. The electric drive as claimed in claim 1, wherein the power source includes at least one asynchronous motor, which is kinematically connected to the wheel of the traveling gear, wherein said means comprising a one-way clutch which is arranged kinematically between the wheel of the traveling gear and the asynchronous motor, and further comprising at least one signal-generator arrangement, which has a first state and a second state, the first state corresponding to a request to switch off a power supply to the asynchronous motor and the second.

30. The electric drive as claimed in claim 1, wherein the power source comprises a series-wound electric motor.

31. A drive system for a wheel of a traveling gear of a hoist, comprising:

an electric motor; and an electric control device which is coupled to said motor and which is operable to control a supply of power to said wheel from said motor, said electric control device including one-way clutch simulator means for at least substantially terminating the supply of power to said wheel from said motor whenever an externally acting force is imposed on said hoist that tends to accelerate said traveling gear.

32. A drive system as defined in claim 31, wherein said electric control device is operable to control a supply of power to said motor, and wherein said one-way clutch simulator means terminates the supply of power to said motor whenever said externally imposed force is present.

33. A drive system as defined in claim 31, wherein said electric motor comprises a series-wound motor.

34. A method of driving a wheel of a traveling gear of a hoist, comprising:

transferring motive power to said wheel from a universal electric motor; and automatically at least substantially terminating the supply of power to said wheel whenever an externally acting force is imposed on said hoist that tends to accelerate said traveling gear.

35. A method as defined in claim 34, wherein the step of automatically at least substantially terminating the supply of power to said wheel comprises altering the transmission of an electric signal to a component of an electric drive system for said wheel, said electric drive system including said motor.

36. A method as defined in claim 35, wherein the step of automatically at least substantially terminating the supply of power to said wheel comprises at least essentially terminating the supply of electric power to said motor.

* * * * *